US007679582B2

(12) United States Patent
Choi

(10) Patent No.: US 7,679,582 B2
(45) Date of Patent: Mar. 16, 2010

(54) METHOD FOR DRIVING A PLASMA DISPLAY PANEL

(75) Inventor: Jeong Pil Choi, Suwon-si (KR)

(73) Assignee: LG Electronics Inc., Seoul (KR)

( * ) Notice: Subject to any disclaimer, the term of this patent is extended or adjusted under 35 U.S.C. 154(b) by 977 days.

(21) Appl. No.: 10/860,606

(22) Filed: Jun. 4, 2004

(65) Prior Publication Data

US 2004/0246205 A1 Dec. 9, 2004

(30) Foreign Application Priority Data

Jun. 5, 2003 (KR) ..... 10-2003-0036300

(51) Int. Cl.
*G09G 3/28* (2006.01)

(52) U.S. Cl. ..... 345/60

(58) Field of Classification Search ..... 345/60–72
See application file for complete search history.

(56) References Cited

U.S. PATENT DOCUMENTS

| | | | | |
|---|---|---|---|---|
| 6,603,446 | B1 * | 8/2003 | Kanazawa et al. | 345/60 |
| 2002/0030645 | A1 | 3/2002 | Lee et al. | 345/68 |
| 2003/0011542 | A1 | 1/2003 | Nakamura | 345/63 |

FOREIGN PATENT DOCUMENTS

JP 11-282415 10/1999

OTHER PUBLICATIONS

Jang, Sang-Hun, et al.; "Improvement of Luminance and Luminous Efficiency Using Address Voltage Pulse During Sustain-Period of AC-PDP," IEEE Transations on Electron Devices, vol. 48, No. 9, Sep. 2001, pp. 1903-1910.
European Search Report dated Jul. 11, 2006.
Chinese Office Action dated Aug. 31, 2007.
Jang et al.,"Improvement of Luminance and Luminous Efficiency using Address Voltage Pulse during Sustain-Period of AC-PDP" IEEE Transaction on Electron Devices, IEEE Service Center, Pisacataway, NJ, US, vol. 48, No. 9., Sep. 2001, pp. 1903-1910.
European Search Report dated Jul. 21, 2006.
Korean Office Action dated Jan. 27, 2005.

* cited by examiner

*Primary Examiner*—Sumati Lefkowitz
*Assistant Examiner*—Ke Xiao
(74) *Attorney, Agent, or Firm*—Ked & Associates LLP

(57) ABSTRACT

The present invention relates to a plasma display panel, and more particularly, to a method for driving a plasma display panel. The driving method of the plasma display panel according to the present invention comprises the steps of: supplying alternately a sustain pulse to a scanning electrode and a sustain electrode during a sustain period; and supplying a DC voltage of positive polarity to an address electrode during a part of the sustain period. According to the driving method of the plasma display panel of the present invention, it is possible to achieve a stable address discharge and to prevent the damage of the circuit components and the erroneous discharge owing to excessive voltage fluctuation.

9 Claims, 8 Drawing Sheets

METHOD FOR DRIVING A PLASMA DISPLAY PANEL

This Nonprovisional application claims priority under 35 U.S.C. §119(a) on Patent Application No. 10-2003-0036300 filed in Korea on Jun. 5, 2003, the entire contents of which are hereby incorporated by reference.

BACKGROUND OF THE INVENTION

1. Field of the Invention

The present invention relates to a plasma display panel, and more particularly, to a method for driving a plasma display panel.

2. Description of the Background Art

A plasma display panel (hereinafter, referred to as a 'PDP') is adapted to display an image by light-emitting phosphors with ultraviolet rays generated during the discharge of an inert mixed gas such as He+Xe, Ne+Xe or He+Ne+Xe, or the like. This PDP can be easily made thin and large, and it can provide greatly increased image quality with the recent development of the relevant technology.

Referring now to FIG. 1, a discharge cell of a three-electrode AC surface discharge type PDP includes a scan electrode 30Y and a sustain electrode 30Z which are formed on the bottom surface of an upper substrate 10, and an address electrode 20X formed on a lower substrate 18. Each of the scan electrode 30Y and the sustain electrode 30Z include transparent electrodes 12Y and 12Z, and metal bus electrodes 13Y and 13Z which have a line width smaller than that of the transparent electrodes 12Y and 12Z and are respectively disposed at one side edges of the transparent electrodes. The transparent electrodes 12Y and 12Z, which are generally made of ITO (indium tin oxide), are formed on the bottom surface of the upper substrate 10. The metal bus electrodes 13Y and 13Z, which are generally made of metal such as chromium (Cr), are formed on the transparent electrodes 12Y and 12Z, and serves to reduce a voltage drop caused by the transparent electrodes 12Y and 12Z having high resistance.

On the bottom surface of the upper substrate 10 in which the scan electrode 30Y and the sustain electrode 30Z are placed parallel to each other, is laminated an upper dielectric layer 14 and a protective layer 16. The upper dielectric layer 14 is accumulated with a wall charge generated during plasma discharging. The protective layer 16 is adapted to prevent damages of the upper dielectric layer 14 due to sputtering caused during plasma discharging, and improve efficiency of secondary electron emission. As the protective layer 16, magnesium oxide (MgO) is generally used.

A lower dielectric layer 22 and a barrier rib 24 are formed on the lower substrate 18 in which the address electrode 20X is formed. A phosphor layer 26 is applied to the surfaces of both the lower dielectric layer 22 and the barrier rib 24. The address electrode 20X is formed in the direction of crossing the scan electrode 30Y and the sustain electrode 30Z. The barrier rib 24 is disposed in parallel with the address electrode 20X and prevents ultraviolet rays and visible lights to be caused during plasma discharging from getting leaked to an adjacent discharge cells. The phosphor layer 26 is excited with an ultraviolet ray generated during the plasma discharging to generate any one visible light of red, green and blue lights. An inert mixed gas is injected into the discharge spaces defined between the upper substrate 10 and the barrier ribs 24 and between the lower substrate 18 and the barrier ribs 24.

In this PDP, one frame is divided into a plurality of sub-fields which having different luminance frequencies and is driven with time division, thereby implementing the gradation of image. Each of sub-fields are divided into an initialization period for initializing an entire screen, an address period for selecting an address line and selecting a cell from the selected address line, and a sustain period for implementing gradation of image in response to the luminance frequency. Herein, the initialization period consists of a setup period which provided with a rising ramp waveform and a setdown period which provided with a falling ramp waveform.

For example, when displaying an image with 256-level gray scale, a period (16.67 ms) of one frame that corresponds to 1/60 second is divided into eight sub-fields (SF1 to SF8), as shown in FIG. 2. Each of the eight sub-fields (SF1 to SF8) consists of the initialization period, the address period, and the sustain period, as mentioned above. The initialization periods and the address periods of each of the sub-fields have equal intervals. But the sustain periods of each of the sub-fields have increasing intervals in the ratio of $2^n$ (n=0, 1, 2, 3, 4, 5, 6, 7).

FIG. 3 shows a driving waveform of PDP which provided to two sub-fields.

In FIG. 3, Y indicates a scanning electrode and Z indicates a sustain electrode, and X indicates an address electrode.

Referring to FIG. 3, a PDP is driven with a reset period for initializing an entire screen and an address period for selecting a cell, and a sustain period for maintaining the discharge of the selected cell.

In the reset period, a rising ramp waveform (Ramp-up) is applied to all scanning electrodes Y during a setup period. This rising ramp waveform (Ramp-up) makes the cells of the entire screen to generate a weak discharge, thereby forming a wall charge in the cells. In the setdown period, after being provided with the rising ramp waveform (Ramp-up), a falling ramp waveform (Ramp-down) which is falling in the positive polarity lower than a peak voltage of the rising ramp waveform (Ramp-up) is applied to the scanning electrodes Y, simultaneously. The falling ramp waveform (Ramp-down) makes the cells to generate a weak discharge, so that an unnecessary charge of wall charge and space charge generated by the setup discharge may be removed and a wall charge which is necessary for address discharge in the cells of the entire screen may be remained uniformly.

In the address period, scan pulses (scan) of a negative polarity are sequentially applied to the scanning electrodes Y, and in the same time, data pulses (data) of positive polarity are applied to the address electrodes X. A voltage difference between the scan pulses (scan) and the data pulses (data) is added to the wall charge generated during the initialization period, so that an address discharge may be generated in the cells to which the data pulses (data) are applied. Therefore, a wall charge generates in the cells selected by the address discharge.

On the other hand, during the setdown period and the address period, the sustain electrodes Z is provided with a DC voltage of positive polarity having a sustain voltage level Vs.

In the sustain period, sustain pulses (sus) are alternatively applied to the scanning electrodes Y and the sustain electrodes Z. Then, the cells selected by the address discharge are added with the wall voltage and sustain pulses (sus) in the cells, so that a sustain discharge may be generated in the form of surface discharge between the scanning electrode Y and the sustain electrode Z whenever the application of the sustain pulses (sus). Finally, after completion of the sustain discharge, the sustain electrode Z is supplied with an erasing ramp waveform (erase) having small pulse width, and the wall charge in the cells is erased the erasing ramp waveform.

However, the conventional PDPs have problems in that a discharge efficiency become lower by the wall charge to be formed in the address electrode X. More specifically, the address electrodes X maintains a base potential during the sustain period that the sustain pulses is alternatively supplied to the scanning electrodes Y and the sustain electrodes Z.

Herein, the address electrodes X maintaining the base potential are accumulated with predetermined wall charges generated from the sustain discharge. This wall charges causes the sustain discharge having a low luminance efficiency. In practical, the wall charges formed in the address electrodes X have a wall voltage that is equal to around half voltage of the sustain pulses.

In order to solve this problem, it has proposed that the address electrodes X are supplied with a DC voltage of positive polarity having an address voltage level Va during a sustain period, as shown in FIG. 4. When the address electrodes X are supplied with the DC voltage of positive polarity during the sustain period, the wall charges generated in the address electrodes X become minimized, the driving efficiency becomes higher, accordingly. In other words, a stable sustain discharge is achieved by lowering the wall voltage of the wall charges formed in the address electrodes X. Practically, it has experimentally proved that the driving efficiency of PDP is improved when the address electrodes X had been supplied with the DC voltage of positive polarity during the sustain period.

However, a driving method shown in FIG. 4 has a problem that an erroneous discharge is generated when there are both a selective write subfield and a selective erase sub-field. Referring to FIG. 5, the selective erase sub-fields are consisted of the address period and the sustain period, thus the address discharge of the address period is followed immediately after completion of the sustain period. Herein, in order to higher the driving efficiency, if the address electrodes X is supplied with the DC voltage of positive polarity having the address voltage level during the sustain period in the subfields before beginning of the selective erase sub-fields, a discharge condition is changed. Therefore, an amount of the wall charges of positive polarity which is accumulated in the address electrodes X may be decreased accordingly, and in the subsequent address period, the amount of the wall voltage in the address electrodes X becomes insufficient, thereby generating an erroneous discharge.

SUMMARY OF THE INVENTION

Accordingly, an object of the present invention is to solve at least the problems and disadvantages of the background art.

An object of the present invention is to provide a method for driving a plasma display panel which can improve a driving efficiency and prevent an erroneous discharge.

According to an embodiment of the present invention, a method for driving a plasma display panel comprises the steps of: supplying alternately a sustain pulse to a scanning electrode and a sustain electrode during a sustain period; and supplying a DC voltage of positive polarity to an address electrode during a part of the sustain period.

BRIEF DESCRIPTION OF THE DRAWINGS

The invention will be described in detail with reference to the following drawings in which like numerals refer to like elements.

DETAILED DESCRIPTION OF PREFERRED EMBODIMENTS

A method for driving a plasma display panel according to an embodiment of the present invention comprises the steps of: supplying alternately a sustain pulse to a scanning electrode and a sustain electrode during a sustain period; and supplying a DC voltage of positive polarity to an address electrode during a part of the sustain period.

In the method for driving a plasma display panel, the DC voltage of positive polarity is supplied during a period with the exception of a latter part of the sustain period.

In the method for driving a plasma display panel, the latter part of the sustain period is a period including at least one sustain pulse.

In the method for driving a plasma display panel, the latter part of the sustain period is supplied with a base potential of the address electrode.

In the method for driving a plasma display panel, the base potential is supplied to the scanning electrode and the sustain electrode when a voltage applied to the address electrode is changed from the DC voltage of positive polarity to the base potential.

Other features and advantages of the invention will be apparent from the following description taken in connection with the accompanying drawing.

Preferred embodiments of the present invention will be described in a more detailed manner with reference to the accompanying FIG. 6 to FIG. 9.

Figure 1:
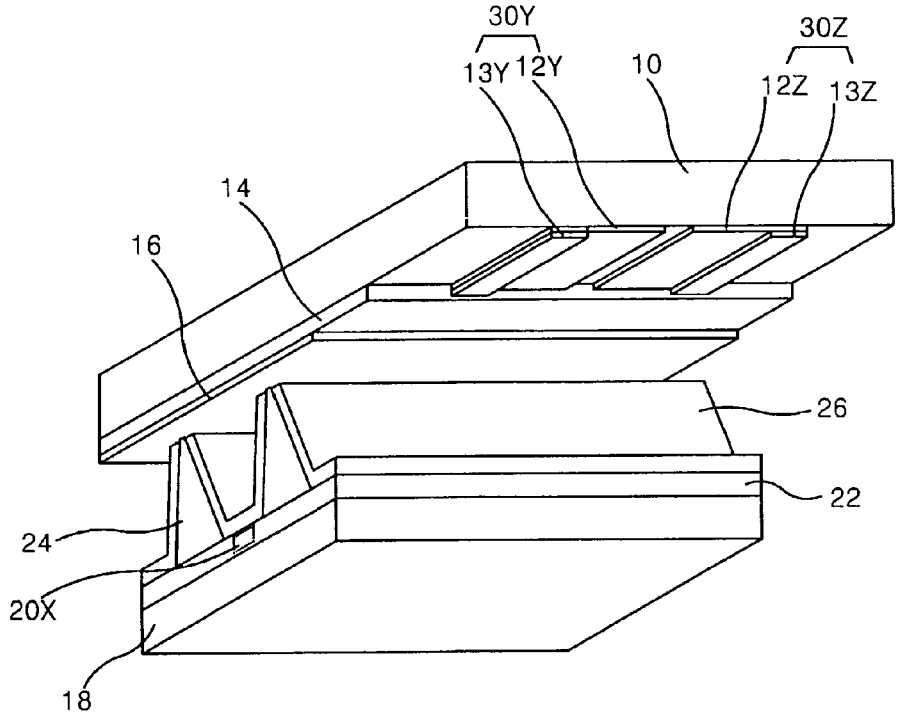
FIG. 1 is a perspective view showing the configuration of a discharge cell of a conventional three-electrode AC surface discharge type plasma display panel.
Figure 2:
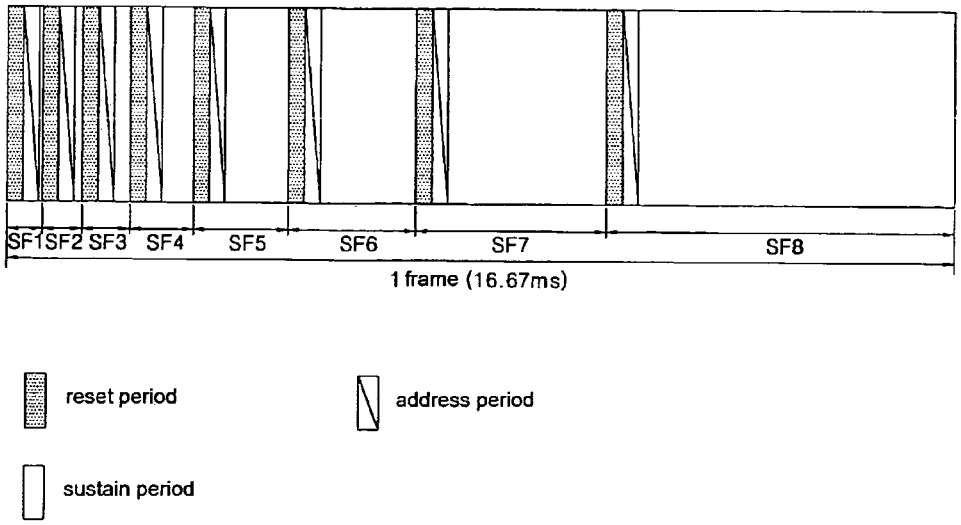
FIG. 2 is a diagram showing a frame of a plasma display panel shown in FIG. 1.
Figure 3:
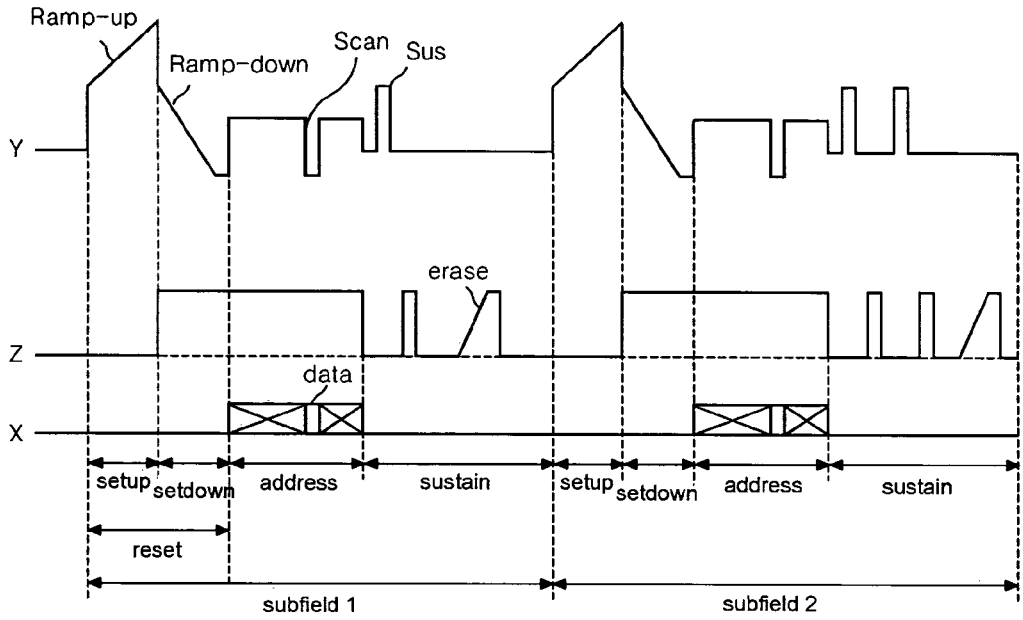
FIG. 3 is a waveform diagram showing an driving waveform applied to a plasma display panel shown in FIG. 1.
Figure 4:
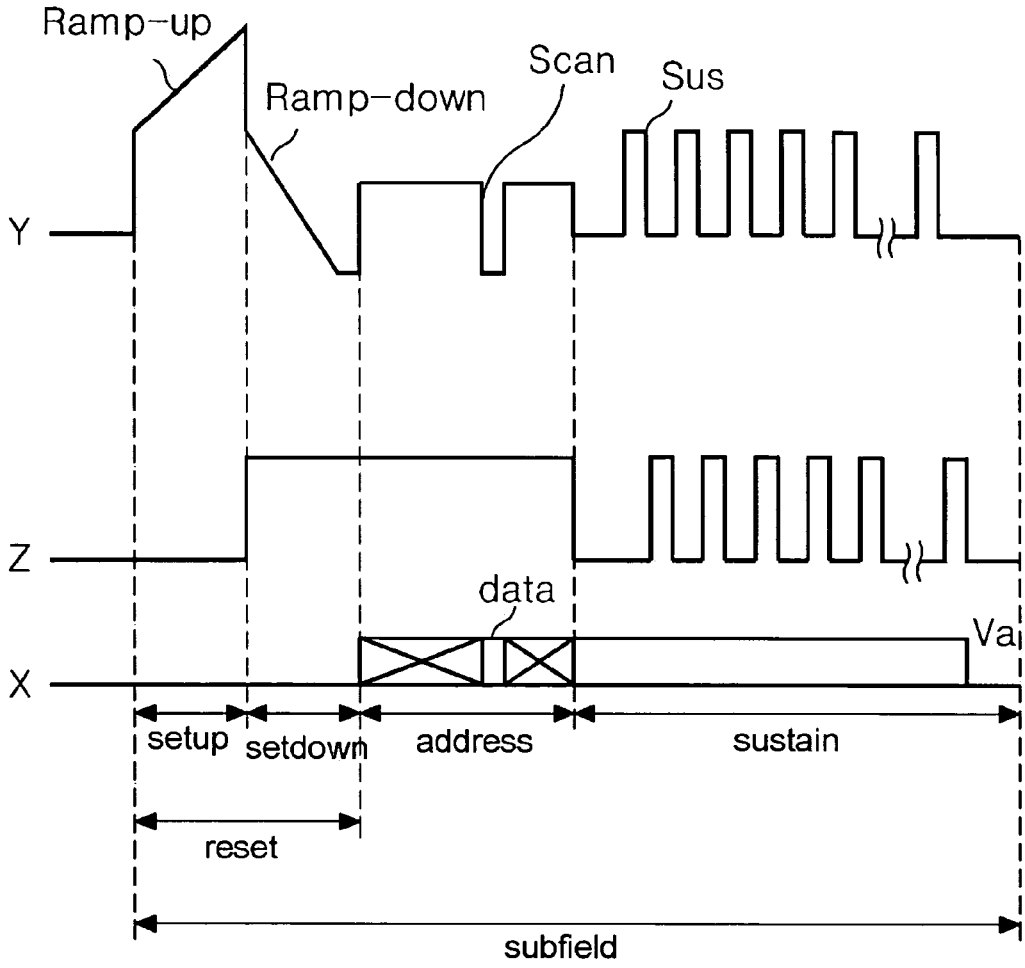
FIG. 4 is a waveform diagram showing another driving waveform applied to a plasma display panel shown in FIG. 1.
Figure 5:
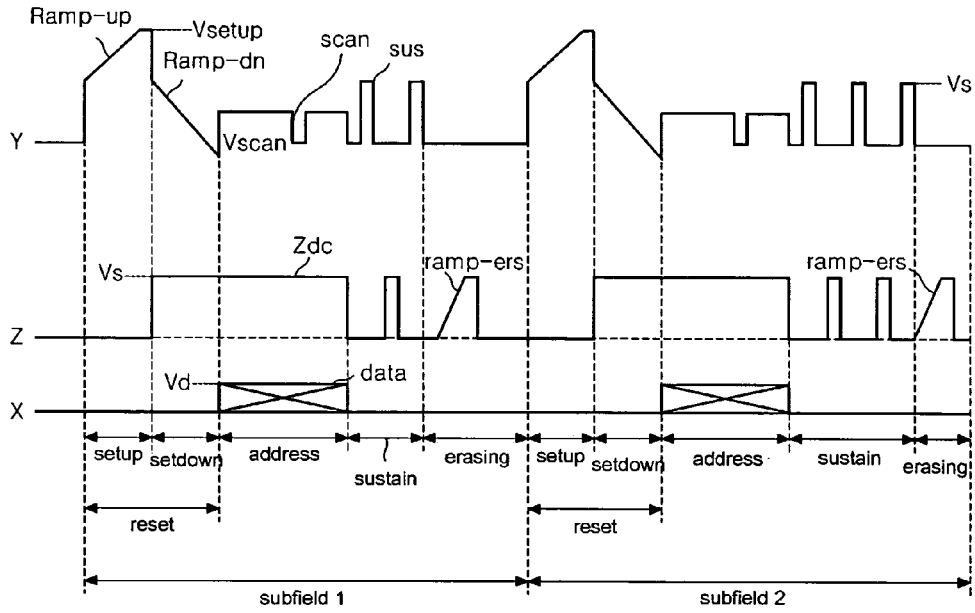
FIG. 5 is a diagram showing a method for driving a plasma display panel to be driven with a selective write mode and a selective erase mode by using the driving waveform shown in FIG. 4.
Figure 6:
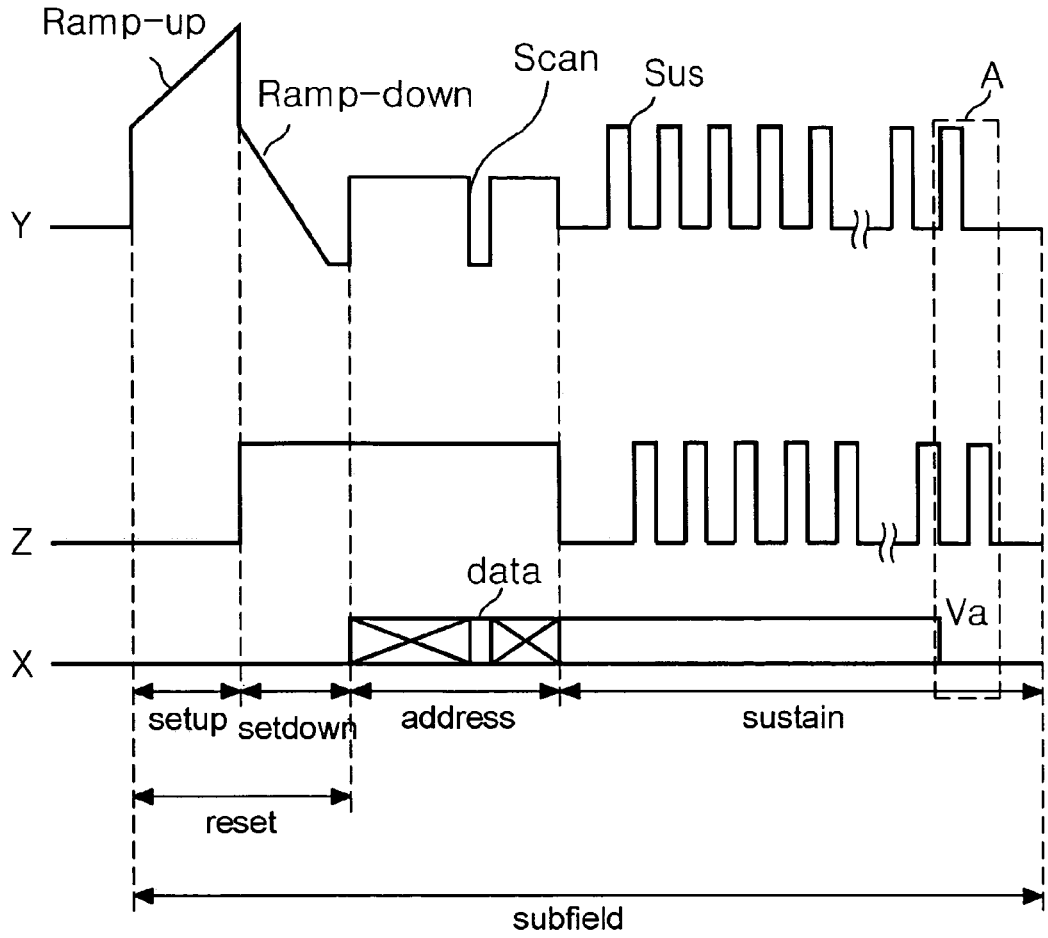
FIG. 6 is a diagram showing a method for driving a plasma display panel according to a first embodiment of the present invention.

FIG. 6 is a diagram showing a method for driving a plasma display panel according to a first embodiment of the present invention. In the FIG. 6, Y indicates a scanning electrode and Z indicates a sustain electrode, and X indicates an address electrode.

Referring to FIG. 6, a PDP according to the first embodiment of the present invention is driven with a reset period for initializing an entire screen, an address period for selecting a cell, and a sustain period for maintaining discharge of the selected cells.

In the reset period, a rising ramp waveform (Ramp-up) is simultaneously applied to all scanning electrodes Y during a setup period. This rising ramp waveform (Ramp-up) causes a weak discharge within the cells of the entire screen, thereby forming a wall charge in the cells. In the setdown period, after being provided with the rising ramp waveform (Ramp-up), a falling ramp waveform (Ramp-down) which is falling in the positive polarity lower than a peak voltage of the rising ramp waveform (Ramp-up) is applied to the scanning electrodes Y, simultaneously. The falling ramp waveform (Ramp-down) causes a weak erase discharge within the cells, so that an unnecessary charge of wall charge and space charge generated by the setup discharge may be removed and a wall charge which is necessary for address discharge in the cells of the entire screen may be remained uniformly.

In the address period, scan pulses (scan) of a negative polarity are sequentially applied to the scanning electrodes Y, in the same time, data pulses (data) of positive polarity are applied to the address electrodes X. A voltage difference between the scan pulses (scan) and the data pulses (data) is added to the wall charge generated during the initialization period, so that an address discharge may be generated in the cells to which the data pulses (data) are applied. Therefore, a wall charge generates in the cells selected by the address discharge.

On the other hand, during the setdown period and the address period, the sustain electrodes Z is provided with a DC voltage of positive polarity having a sustain voltage level Vs.

In the sustain period, sustain pulses (sus) are alternatively applied to the scanning electrodes Y and the sustain electrodes Z. And, the address electrodes X are applied with a DC voltage of positive polarity having the address voltage level Va before supplying of at least one sustain pulse, for example the last sustain pulse pair, during the sustain discharge. Then, the cells selected by the address discharge are added with the wall voltage and sustain pulses (sus) in the cells, so that a sustain discharge may be generated in the form of surface discharge between the scanning electrode Y and the sustain electrode Z whenever the application of the sustain pulses (sus). The address electrodes X are applied with the DC voltage of positive polarity having the address voltage level Va, and the wall charges are not accumulated in the address electrodes X, so the sustain discharge is more efficiently generated. Furthermore, even though the address electrodes X are applied with a base potential and the process is directly advanced from the address period to the selective erase sub-fields in at least one sustain pulse, for example the last sustain pulse pair, during the sustain discharge as shown in (A) of FIG. 6, the address discharge become implemented because the amount of wall voltage of the address electrodes X is sufficient.

Figure 7:
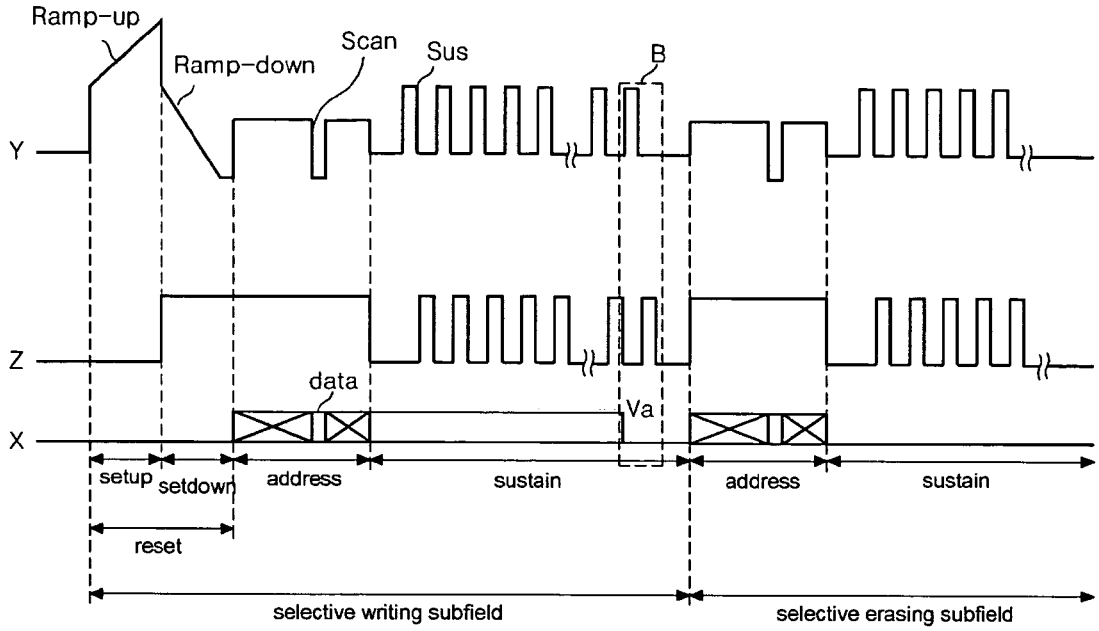
FIG. 7 is a diagram showing a method for driving a plasma display panel to be driven with a selective write mode and a selective erase mode by using the driving waveform shown in FIG. 6.

More specifically, when the selective erase sub-fields follows the selective write sub-fields as shown in FIG. 7, the sustain period of the last selective write sub-fields may be regarded as a reset period for the first selective erase sub-fields subsequent following the last selective write sub-fields.

During this sustain period, a driving efficiency is improved by application the DC voltage of positive polarity having the address voltage level Va to the address electrodes X in order not to accumulate the wall charges to the address electrodes X. However, when the DC voltage of positive polarity having the address voltage level Va is applied to the address electrodes X, an amount of the wall charges which is accumulated in the address electrodes X may be decreased, accordingly, and then in the address discharge of the subsequent selective erase sub-fields, the amount of the wall voltage in the address electrodes X becomes insufficient, thereby generating an erroneous discharge. Therefore, as shown in FIG. 7, in at least one sustain pulse, for example the last sustain pulse pair, before completion of the sustain discharge of the last selective write sub-field immediately before proceeding to the selective erase sub-field, the address electrodes X is applied with a base potential as shown in (B) of FIG. 7. Consequently, since the address electrodes X are sufficiently accumulated with the wall charges, even though the process is directly advanced to the selective erase sub-fields in which the address period immediately begin, the stable address discharge can be achieved because the amount of wall voltage of the address electrodes X is sufficient.

On the other hand, the sustain pulses are normally supplied to the scanning electrodes Y and the sustain electrodes Z with alternation. The interval of two sustain pulses which are supplied alternatively is successively operated with the sustain operation without interruption. If any interruption time is obtained from the interval of two sustain pulses which are supplied alternatively, only very short time interval (around maximum few hundreds ns) will be possible. In the actual driving, it is very difficult to maintain a stable voltage owing to a discharge current and a rising phenomenon. Thus, in the operation period of the sustain pulse without interruption, if the DC voltage of positive polarity having the address voltage level Va applied to the address electrodes X is removed as in the first embodiment of the present invention, there may occur damage of the circuit components and erroneous discharge owing to excessive voltage fluctuation. Accordingly, a driving method as shown in FIG. 8 is proposed.

Figure 8:
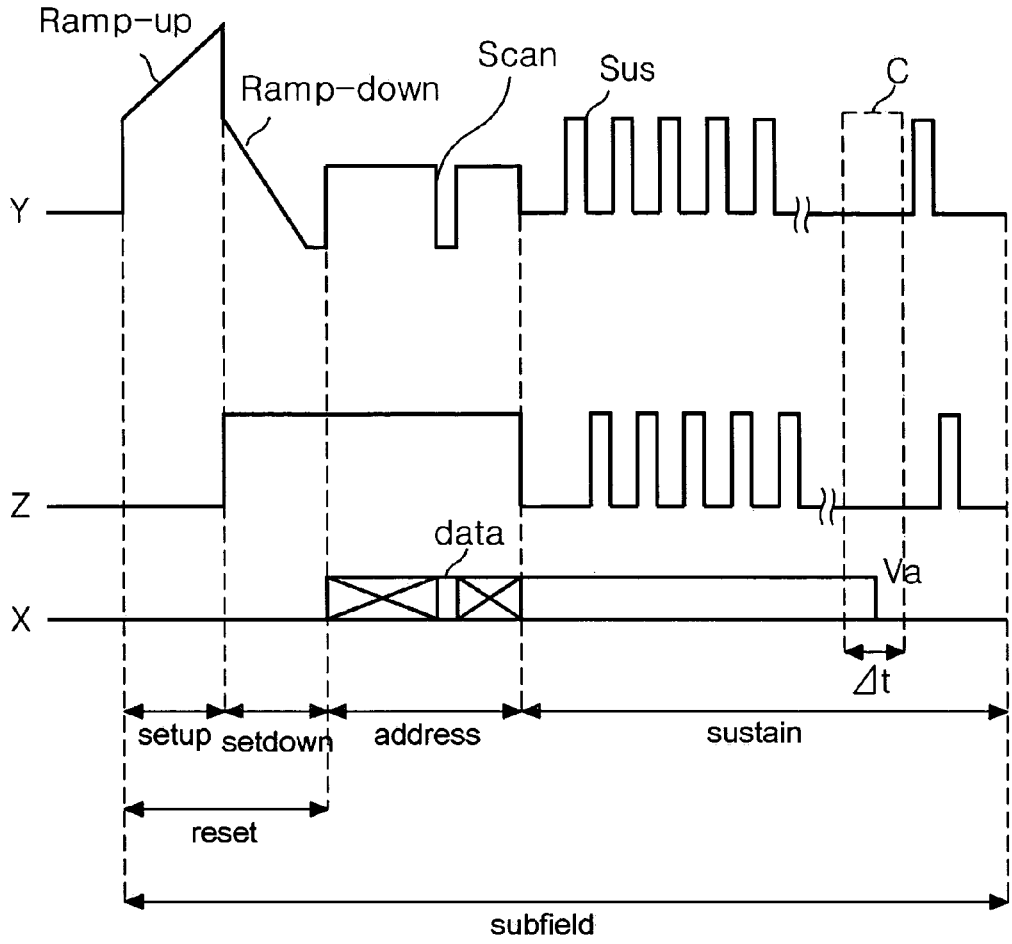
FIG. 8 is a diagram showing a method for driving a plasma display panel according to a second embodiment of the present invention.

FIG. 8 is a diagram showing a method for driving a plasma display panel according to a second embodiment of the present invention.

Referring to FIG. 8, a PDP according to the second embodiment of the present invention is driven with a reset period for initializing an entire screen, an address period for selecting a cell, and a sustain period for maintaining discharge of the selected cells.

In the reset period, a rising ramp waveform (Ramp-up) is simultaneously applied to all scanning electrodes Y during a setup period. This rising ramp waveform (Ramp-up) causes a weak discharge within the cells of the entire screen, thereby forming a wall charge in the cells. In the setdown period, after being provided with the rising ramp waveform (Ramp-up), a falling ramp waveform (Ramp-down) which is falling in the positive polarity lower than a peak voltage of the rising ramp waveform (Ramp-up) is applied to the scanning electrodes Y, simultaneously. The falling ramp waveform (Ramp-down) causes a weak erase discharge within the cells, so that an unnecessary charge of wall charge and space charge generated by the setup discharge may be removed and a wall charge which is necessary for address discharge in the cells of the entire screen may be remained uniformly.

In the address period, scan pulses (scan) of a negative polarity are sequentially applied to the scanning electrodes Y, and in the same time, data pulses (data) of positive polarity are applied to the address electrodes X. A voltage difference between the scan pulses (scan) and the data pulses (data) is added to the wall charge generated during the initialization period, so that an address discharge may be generated in the cells to which the data pulses (data) are applied. Therefore, a wall charge generates in the cells selected by the address discharge.

On the other hand, during the setdown period and the address period, the sustain electrodes Z is provided with a DC voltage of positive polarity having a sustain voltage level Vs.

In the sustain period, a sustain pulses (sus) are alternatively applied to the scanning electrodes Y and the sustain electrodes Z. And, the address electrodes X are applied with a DC voltage of positive polarity having the address voltage level Va before supplying of at least one sustain pulse, for example the last sustain pulse pair, during the sustain discharge. In this time, during a predetermined interval (Δt) before and after the time when the DC voltage of positive polarity having the address voltage level Va applied to the address electrodes X is dropped to the base potential, a base potential is applied to the scanning electrodes Y and the sustain electrodes Z. Then, the cells selected by the address discharge are added with the wall voltage and sustain pulses (sus) in the cells, so that a sustain discharge may be generated in the form of surface discharge between the scanning electrode Y and the sustain electrode Z whenever the application of the sustain pulses (sus). The address electrodes X are applied with the DC voltage of positive polarity having the address voltage level Va, and the wall charges are not accumulated in the address electrodes X, so the sustain discharge is more efficiently generated. Furthermore, even though the process is directly advanced to the selective erase sub-fields in which the address period immediately begin by application of the base potential to the address electrodes X in at least one sustain pulse, for example the last sustain pulse pair, before completion of the sustain discharge as shown in (A) of FIG. 8, and by application the base potential to the scanning electrodes Y and the sustain electrodes Z during a predetermined interval (Δt) before and after the time when the DC voltage of positive polarity having the address voltage level Va applied to the address electrodes X is dropped to the base potential, not only it is possible to achieve the stable address discharge, but also it is possible to prevent the damage of the circuit components and the erroneous discharge owing to excessive voltage fluctuation, because the amount of wall voltage of the address electrodes X is sufficient.

Figure 9:
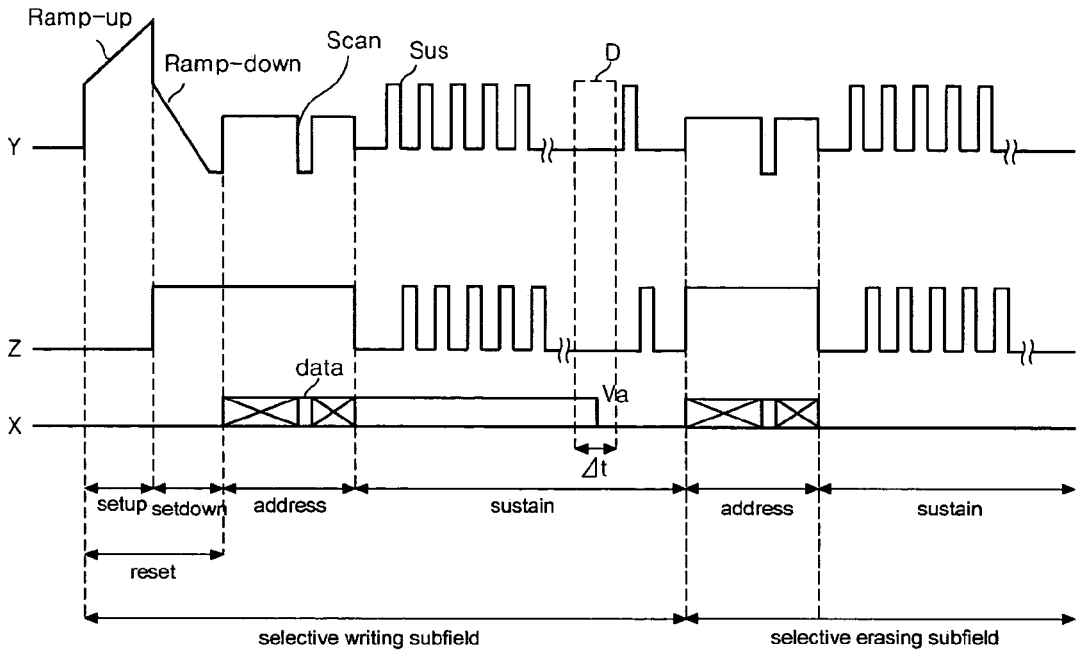
FIG. 9 is a diagram showing a method for driving a plasma display panel to be driven with a selective write mode and a selective erase mode by using the driving waveform shown in FIG. 8.

More specifically, when the selective erase sub-fields follows the selective write sub-fields as shown in FIG. 9, the sustain period of the last selective write sub-fields may be regarded as a reset period for the first selective erase sub-fields following the last selective write sub-fields. During this sustain period, a driving efficiency is improved by application the DC voltage of positive polarity having the address voltage level Va to the address electrodes X in order not to accumulate the wall charges to the address electrodes X. However, when the DC voltage of positive polarity having the address voltage level Va is applied to the address electrodes X, an amount of the wall charges which is accumulated in the address electrodes X may be decreased accordingly, and then in the address discharge of the subsequent selective erase sub-fields, the amount of the wall voltage in the address electrodes X becomes insufficient, therefore the erroneous discharge may be caused. Furthermore, in the operation period of the sustain pulse without interruption, if the DC voltage of positive polarity having the address voltage level Va applied to the address electrodes X is removed, there may occur damage of the circuit components and the erroneous discharge owing to excessive voltage fluctuation. Therefore, as shown in FIG. 9, even though the process is directly advanced to the selective erase sub-fields in which the address period immediately begin by application of the base potential to the address electrodes X in at least one sustain pulse, for example the last sustain pulse pair, before completion of the sustain discharge as shown in (D) of FIG. 9, and by application the base potential to the scanning electrodes Y and the sustain electrodes Z during a predetermined interval (Δt) before and after the time when the DC voltage of positive polarity having the address voltage level Va applied to the address electrodes X is dropped to the base potential, not only it is possible to achieve the stable address discharge, but it is also possible to prevent the damage of the circuit components and the erroneous discharge owing to excessive voltage fluctuation, because the amount of wall voltage of the address electrodes X is sufficient.

As described above, according to the driving method of the plasma display panel according to the present invention, in order to improve the driving efficiency, the base potential is applied in the period corresponding to the at least one sustain pulse before completion of the sustain discharge when the DC voltage of positive polarity having the address voltage level is supplied to the address electrodes during the sustain period, thereby stabilizing the subsequent address discharge.

Further, during a predetermined interval (Δt) before and after the time when the DC voltage of positive polarity having the address voltage level Va applied to the address electrodes X is dropped to the base potential, a base potential is applied to the scanning electrodes Y and the sustain electrodes Z, thereby preventing the damage of the circuit components and the erroneous discharge owing to excessive voltage fluctuation.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A method for driving a plasma display panel, comprising:

alternately applying sustain pulses to a scanning electrode and a sustain electrode during a sustain period in a selective writing subfield, the selective writing subfield immediately followed by a selective erasing subfield, the selective writing subfield having a reset period and the selective erasing subfield omitting a reset period;

applying a first voltage to an address electrode in the selective writing subfield, the first voltage applied to the address electrode except a time when at least a last pair of sustain pulses is alternately applied to the scanning and sustain electrodes during the sustain period; and applying a second voltage to the address electrode during the time when the last pair of sustain pulses is alternately applied to the scanning and sustain electrodes during the selective writing subfield, wherein the first voltage is a DC voltage of positive polarity and the second voltage is lower than said DC voltage, wherein:

an interim period of time in which the second voltage is applied to the address electrode, during the time when the last pair of sustain pulses is alternatively applied to the scanning and sustain electrodes during the selective writing subfield, allows for a distribution of wall charges to be generated relative to one or more of the scanning electrode, sustain electrode, or address electrode sufficient to serve as a reset period for the selective erasing subfield, and an address period of the selective erasing subfield immediately follows said interim period of time in the selective writing subfield.

2. The method of claim 1, wherein the first voltage is applied to the address electrode before a first sustain pulse is applied to either one of the scanning electrode or the sustain electrode during the selective writing subfield.

3. The method of claim 1, wherein the second voltage is applied at a time substantially coincident with an end of a second to last sustain pulse applied to one of the scanning electrode or the sustain electrode.

4. The method of claim 1, wherein a time in the selective writing subfield when the second voltage is applied to the address electrode serves as a reset period for the selective erasing subfield.

5. The method of claim 1, wherein the first voltage reduces an accumulation of wall charges for the address electrode during the selective writing subfield.

6. The method of claim 1, wherein the second voltage is at least substantially equal to a base potential.

7. The method of claim 1, wherein the first voltage is applied to the address electrode in the selective writing subfield a predetermined time before the last pair of sustain pulses is alternately applied to the scanning and sustain electrodes.

8. The method of claim 1 wherein the first and second voltages are applied to the address electrode and the sustain pulses are alternately applied to the scanning and sustain electrode during a sustain interval of the selective writing subfield.

9. The method of claim 1, wherein the second voltage applied to the address electrode in said interim period of time in the selective writing subfield is substantially same as a voltage applied to the address electrode during a reset period of the selective writing subfield.

* * * * *